United States Patent [19]

Satto

[11] 4,047,136

[45] Sept. 6, 1977

[54] MOVING MAGNET TYPE INSTRUMENT

[75] Inventor: Seiichi Satto, Iruma, Japan

[73] Assignee: Nihon Beru-Haueru Kabushiki Kaisha (Bell & Howell Japan, Ltd.), Higashimurayama, Japan

[21] Appl. No.: 685,238

[22] Filed: May 11, 1976

[30] Foreign Application Priority Data

| | | |
|---|---|---|
| May 13, 1975 | Japan | 50-56858 |
| May 21, 1975 | Japan | 50-67975 |
| June 10, 1975 | Japan | 50-78490 |

[51] Int. Cl.[2] ..... H01F 7/08

[52] U.S. Cl. ..... 335/222; 324/146

[58] Field of Search ..... 324/146; 335/222, 229, 335/230, 272

[56] References Cited

U.S. PATENT DOCUMENTS

| | | | |
|---|---|---|---|
| 2,968,000 | 1/1961 | Pfeffer | 324/146 |
| 3,327,208 | 6/1967 | Allen | 324/146 X |
| 3,753,107 | 8/1973 | Burgett et al. | 324/146 |
| 3,761,731 | 9/1973 | Burgett et al. | 324/146 X |

*Primary Examiner*—George Harris

*Attorney, Agent, or Firm*—John E. Peele, Jr.; Roger M. Fitz-Gerald

[57] ABSTRACT

For driving exposure control vanes in photographic equipment in response to variations in the quantity of light, a moving magnet type instrument has a magnet which is positioned proximate a fixed field coil wound on a two piece frame. The magnet is formed as a unitary component of magnetic material and plastic material interlocked against separation, and is arranged for displacement in bearings in the frame proximate which a magnet biassing material is arranged to urge the magnet into a position whereby the supported vane is maintained at a relatively constant spacing with respect to a fixed camera component.

7 Claims, 22 Drawing Figures

MOVING MAGNET TYPE INSTRUMENT

This invention relates to an improvement in a galvanometer type instrument having a movable magnet rotatably relative to a fixed coil in response to current flow through the coil.

A primary use of a galvanometer type instrument is for driving iris blades or exposure controlling vanes in photographic equipment such as motion picture cameras. Also, the instrument may drive an indicator relative to a scale to indicate the aperture setting to which a moving component is adjusted in response to the current which flows into a fixed field coil due to variations in the quantity of light influencing a light detector connected in circuit with the coil. Provided is a moving magnet type instrument which controls the exposure with the iris blade driven by the magnet, which magnet is positioned near a fixed field coil wound on a coil frame which is fixed on a base proximate the magnet. The magnet is formed as a unitary component of magnetic material and plastic material interlocked against separation. Also, the magnet is arranged for displacement in bearings in the frame proximate which a magnet biassing material is arranged. The biassing material urges the magnet into a position whereby the supported vane or indicator is maintained at a relatively constant spacing with respect to a fixed camera component such as a lens or a scale.

Prior galvanometer like devices have been relatively complex in construction, and have required significant time to perform the several assembly operations and much care to install the coil about the magnet. Similarly, magnets have been formed by the sintering method of a magnetic substance with a center hole. However, a bushing was required to be inserted in the center hole, and the axis of rotation thereof machined. Such an assembly however required many elements and assembly processes to obtain an accurately aligned magnet providing for repeatable adjustment of the vane or indicator without undue play in the instrument. Often, the play in the instrument permitted the movable vane or indicator to drag on the fixed components relative to which the element moved. Additionally, the instrument was extremely sensitive to shock due to the requirement that the elements be mounted relatively tightly. Further, magnet members molded of "magnetic plastic" have a relatively low density of magnetic flux thereby reducing the sensitivity of the instrument in response to light.

To overcome the several demerits of the above mentioned instruments, a moving magnet type instrument is assembled of a two piece frame. In each of the frame pieces is formed a bearing in which a magnet member is supported to rotate. To improve the smoothness of rotation of the magnet member, a magnet member biassing component is arranged proximate the magnet to cause the field of the magnet to bias the magnet slightly against gravity and friction in the bearings. The bearings are formed and dimensioned slightly larger than the axles of the magnet to enable the slight movement of the magnet in a manner whereby the iris vane or indicator is maintained at a predetermined spacing relative to the lens or an indicator scale. Manufacture of the magnet is simplified by making the member of sintered magnetic material to which is molded in an interlocking manner a plastic material. The resulting magnet member is of high magnetic flux. The resulting moving magnet instrument is assembled of fewer pieces than most comparable units, and can be assembled with minimal labor and less skilled labor. Further, the instrument is less subject to damage by shock and rough handling, yet maintains high sensitivity in response to the low currents which flow through the fixed coil.

An object of the present invention is to provide a relatively simple and easy to assemble instrument having response characteristics comparable to or better than existing instruments.

The above and other objects and advantages of this invention will become more apparent from the detailed description which follows when taken in conjunction with the accompanying drawings in which.

Figure 1:
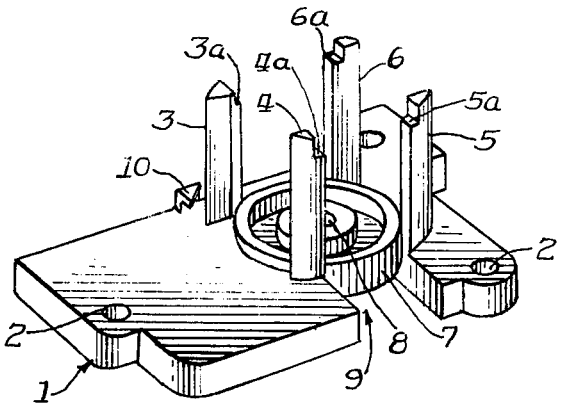
FIG. 1 is an example of a base in a preferred embodiment of the instrument according to the present invention.
Figure 8:
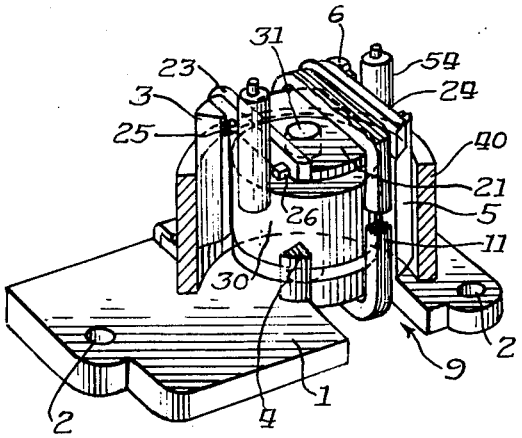
FIG. 8 is a view of an assembled instrument incorporating the preferred embodiments of components, with parts removed and parts broken away for clarity.
Figure 9:
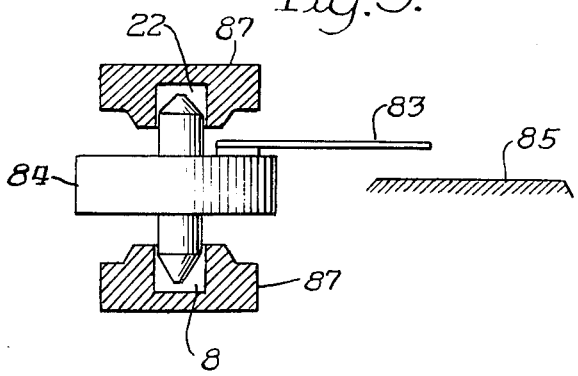
FIG. 9 is a view of one embodiment of an instrument incorporating a magnet member biasing component.
Figure 10:
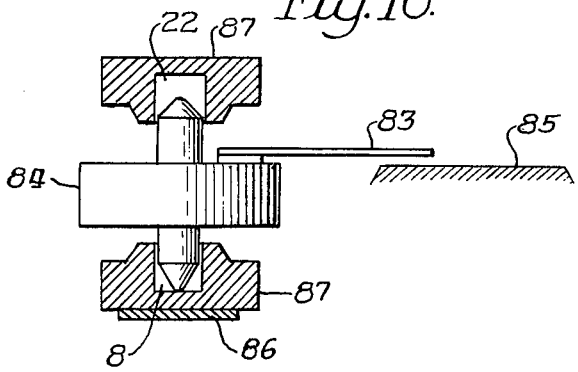
FIGS. 10, 11 and 12 are elevational views of other embodiments of instruments, each incorporating a magnetic member biassing component.

Referring now particularly to FIG. 1 and generally to FIG. 8, the instrument includes a base 1 equipped with supports 3, 4, 5, and 6, formed integrally therewith of a material, such as the polypheylene oxide and styrene combination plastic sold by the General Electric Company under their trademark NORYL. In the base 1, a hole or holes 2 are provided to enable installation of the instrument when assembled, in various devices such as a photographic device and particularly a motion picture camera. On the free ends of the supports 3, 4, 5, and 6 are limit stops 3*a,* 4*a,* 5*a,* and 6*a,* arranged to hold a cover member described hereinafter. The supports are spaced apart sufficiently to surround a magnet which is rotatable within the space delineated thereby. A bearing 8 is provided for a shaft or axle of the movable magnet member, which bearing is formed in the bottom 7 as a part of the base below the space in which the magnet is rotatable. The outermost circumference of the bottom 7 is recessed between the supports 4 and 5, and, between the supports 3 and 6 equally by the thickness of each support from an imaginary line of continuity which links the outer wall of the supports. The recesses keep the coil 11, as shown in FIG. 8, at a definite position and prevent the coil from protruding beyond preset dimensions, when the coil is assembled. On the bottom 7, the base is formed in the manner that the outermost circumference and the circumference of bearing 8 are higher than the intermediate portion so the magnet can be rotated smoothly by reducing the contact area. A space 9 is formed in the base so that the lower surface of bottom 7 is higher than the lower surface of the base which is enclosed by the supports 3–6. This space 9 enables an easy coil assembly operation and keeps the coil at the definite position relative to the lower surface of the bottom 7.

Figure 4:
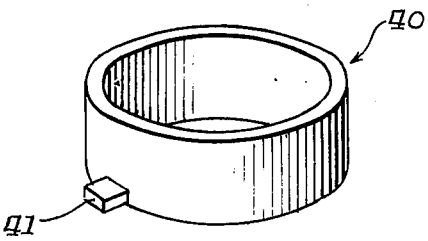
FIG. 4 is a yoke capable of assembly with the instrument.

A stop lug 10 extends upwardly from the base 1 and functions to orient a yoke 40, as shown in FIG. 4. During assembly, the yoke 40 is positioned with a projection 41 against the stop lug, which keeps the yoke from being moved upwardly and from being rotated. The projection 41 on the yoke extends radially from the yoke 40, which may be cemented to the base or a component thereof.

Figure 2:
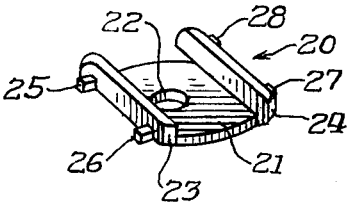
FIG. 2 is a cover member for assembly with the base of FIG. 1.

In FIG. 2 is detailed a cover member 20 having a bearing 22 which is aligned with the bearing 8 of the bottom 7 upon assembly of the components together. The bearing 22 is provided at the central portion of the upper plate portion 21. The upper portion 21 of the cover member 20 is equipped with side plates 23 and 24 which protrude above the upper portion 21 and extend longitudinally or chordally from portions of the circumference of that portion. A series of projections 25, 26, 27, and 28 extend from the plane of the upper plate portion 21.

Figure 3:
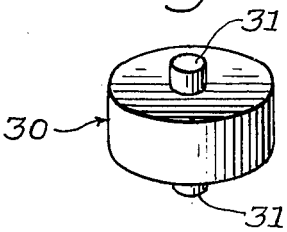
FIG. 3 is a showing of a magnet configured for assembly in the instrument of FIGS. 1 and 2.

A magnet member 30, as shown schematically in FIG. 3, is equipped with an axle 31 which protrudes upwardly and downwardly from the body thereof. The magnet member 30, supported with the axle members inserted into the bearings 8 and 22, is movable both rotatably and axially of the axles in the space surrounded by the supports 3–6.

In the construction as above described, first, the magnet 30 is positioned on the bottom 7 which is the base surrounded by the supports 3–6 with the lower axle 31 inserted into the bearing 8 formed in the bottom. Thereafter, the cover member 20 is positioned above the magnet 30 at a determined, fixed distance from the base 1 in the manner that the side plates 23 and 24 of the cover member are positioned on the stop lugs **3*a* to 6*a* of supports 3 to 6, and the projections 25 and 26 of the cover member are between supports 3 and 4, and the projections 27 and 28 are between supports 5 and 6. The magnet member 30 is prevented from moving in the $x$ and $y$ directions, as shown in FIG. 1, since the axles thereof are retained in the respective bearings of the fixedly positioned cover member 20 and the base 1**.

After the magnet 30 and the cover member 20 have been positioned on base 1, the cover member is fixed to the base by the coil 11 wound between the supports 3 and 6 and between the supports 4 and 5, and utilizing the cover member and the base as two sides of the coil frame. The magnetic field of the coil which varies in response to light impinging on a light sensing member (not shown) influences the magnetic field of the magnet member 30 to cause rotation of the magnet member in response to current flow through the coil.

As further explained hereinafter, the side plates 23 and 24 are higher than the upper plate portion 21 of the cover member 20, and the lower surface of bottom 7 is recessed from the lower surface of the base 1. A coiling operation is easily performed and the coil is retained in a definite position. An indicator or an iris blade (not shown) may be installed on the magnet 30 either before or after the magnet is assembled between the cover member 20 and the base.

Figure 5:
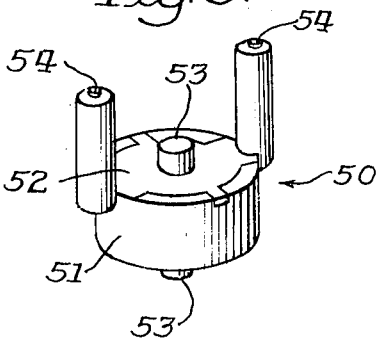
FIG. 5 is a showing of a preferred embodiment of a magnet having blade support posts.

Referring now to FIGS. 5 and 8, another embodiment of the magnet is shown as 50, which is formed by molding as a single piece a metal portion 51 and a plastic portion 52. The latter portion is formed of a plastic material such as either a polyacetal, sold by DuPont under the Trademark DELRIN, or a polycarbonate, sold by General Electric Co. under the Trademark LEXAN. The molded plastic portion 52 is provided with an axle 53 which extends upwardly and downwardly beyond the dimension of the magnet member. At least one support post 54 protrudes above the upper surface of the coil wound on the upper portion of the coil frame in FIG. 2 to provide for supporting the iris blade or the indicator to be driven by the magnet member. In this embodiment, the support post 54 extends above the side plates 23, 24 which are higher than the upper surface of the coil and further is radially disposed beyond the plates for arcuate movement. In this embodiment, in which two support posts are shown, the magnet 50 is supported by the bearings 8 and 22 so that the support posts are positioned for arcuate movement respectively between supports 3 and 4, and between supports 5 and 6.

Since the magnet 50 is provided with the support posts protruding beyond the upper surface of the coil which is wound on the upper plate portion 21, an advantage is noted that the indicator or the iris blade can easily be installed on the magnet even after the magnet has been supported by the cover member and the base, and the coil has been wound on these elements which function as the coil frame. The resulting instrument is applicable for various types of devices, for instance, various cameras with different lenses. In an iris blade is of a particular configuration, that blade can be installed on the instrument after the coil has been wound uniformly for various cameras permitting the same instrument to be used on various designs of a device.

The metal portion 51 and the molded plastic portion 52 of the magnet member 50 are formed in a single piece in this embodiment with the support post 54 molded integrally with the plastic portion. However, the support post 54 can be installed on the metal portion by an adhesive, or can be made of metal, and formed integrally with the metal portion. If one or more is formed in the base to hold the magnet when the iris blade or the indicator is installed after the magnet is assembled in the frame, the magnet can be held by a fixture which is positioned in or passes through the hole.

Figure 6:
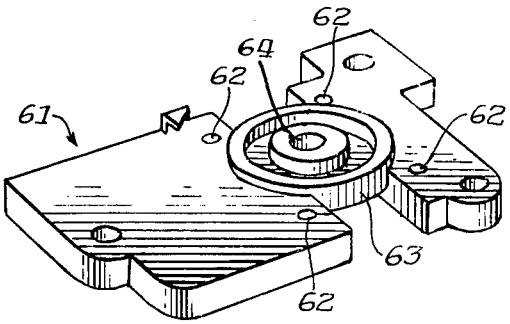
FIGS. 6 and 7 are alternative embodiments of a base and a cover member respectively for an instrument according to this invention.
Figure 7:
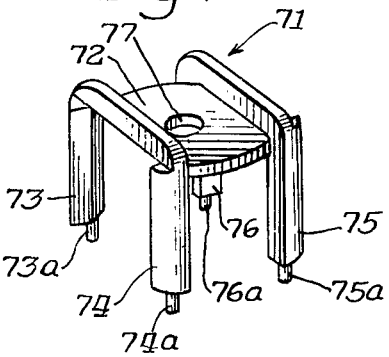

In the embodiment of FIG. 6, the base 61 is shown without the supports as shown on base 1 in FIG. 1. The base 61 is provided with holes 62, in which supports formed integrally with a cover member 71, detailed in FIG. 7, can be positioned. The area which is surrounded by the holes 62 is defined as the bottom 63 on which the movable magnet is positioned and in which bearing 64 is formed. The cover member 71, cooperating with the base 61 of FIG. 6, has an upper portion 72 in which a bearing 77 is formed centrally. Supports 73, 74, 75 and 76 are formed integrally with the upper portion 72, and have on their free ends pins **73*a*, 74*a*, 75*a*, and 76*a* which are fitted into the holes 62 in the base 61**. Together, the supports and pins fix the cover member onto the base at a predetermined distance, while maintaining alignment of the bearings in the respective components. The base and cover member components are used as two sides of a coil of a coil frame within which the magnet can be supported as a very simple construction. Although the embodiments are shown with four supports, other numbers of supports are applicable so long as they maintain the base-to-cover distance and bearing alignment for supporting the magnet and serving as two sides of the coil frame. Also, the axles can be formed respectively on the base and the cover member, and the magnet supporting members and the respective bearings can be formed in the magnet.

Further, in such an embodiment, the moving magnet type instrument may have either an iris blade or an indicator 83 carried on the magnet member 84 for movement relative to a fixed scale or a lens represented as component 85 in FIGS. 9–12. To reduce the influence of gravity and friction causing drag of the magnet member 80 for smooth rotation, and to reduce the likelihood of erratic movement of the iris blade or indicator 83 relative to the scale, a magnetic body 86 is installed proximate one of the bearings 8, 22 in the frame 87 to bias the magnet 84 axially in the bearings. The magnetic field of the magnetic member biassing component 86 functions against the field of the magnet, but in such a manner as not to affect the magnetic field due to the coil. The magnet is thereby enabled to rotate more smoothly than expected with the blade or indicator moving constantly on the same level. Further, in that the magnet is capable of slight movement in an axial direction, the likelihood of damage to the instrument is reduced even if the magnet is forced to be moved slightly in the direction opposite to the magnetic body 86.

Figure 11:
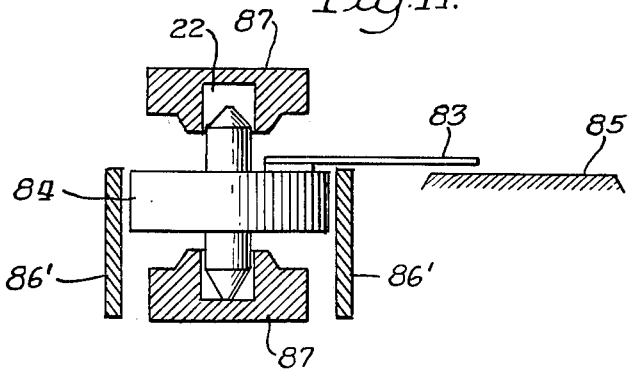

In still another embodiment of the instrument as shown in FIG. 11, the magnet member 84 is positioned within one or more components defining a magnetic body 86', which is positioned to the sides of the magnet, rather than proximate the bearings. Since the magnetic body is arranged not to be equally positioned about the magnet, the resulting magnetic forces cause the magnet to be axially biased in one direction. The magnet remains rotatable about the axis due to the effects that it is biased in one direction by a magnetic body.

Figure 12:
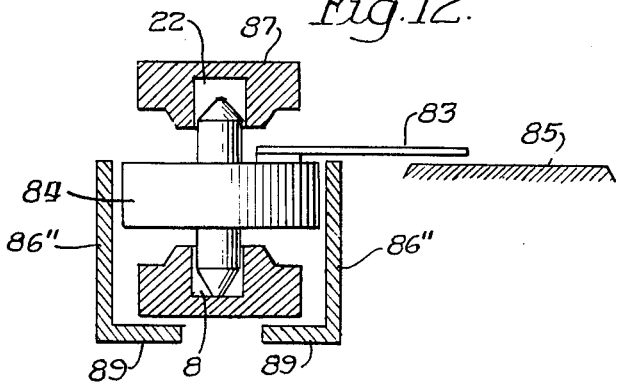

In still another embodiment, as shown in FIG. 12, the magnet 84 is biased effectively by a magnetic body 86" which at least partially surrounds the magnet and has a bent or formed portion 89 which at least partly overlaps another side of the magnet. If the magnetic body is provided with the bent portion, the magnetic body is not required to be positioned unequally along the magnet since the bent portion which covers part of the bearing side of the magnet effectively biases the magnet away from the bent portion. The yoke of FIGS. 4 and 8 normally of non-magnetic material, can be made of magnetic material and used as the magnetic body.

Figure 13:
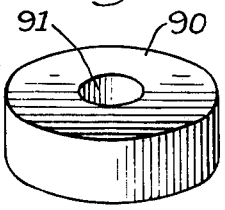
FIG. 13 is a perspective view of the magnetic portion of a magnet member.
Figure 14:
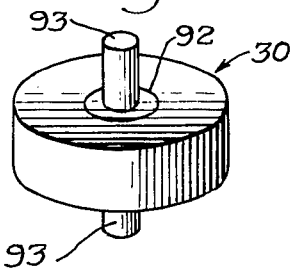
FIG. 14 is a perspective view of a magnetic member including a magnetic ring as shown in FIG. 13.
Figure 15:
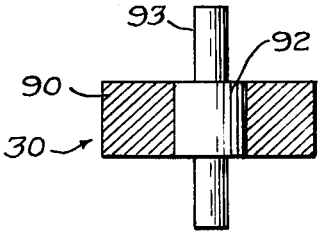
FIG. 15 is an elevational view of the magnetic member of FIG. 13.
Figure 18:
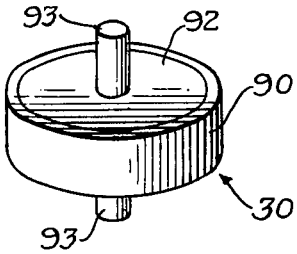
FIGS. 18–22 are views of still other embodiments of magnet members according to the present invention, with some views in section.
Figure 19:
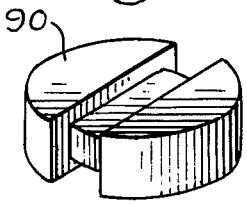
Figure 21:
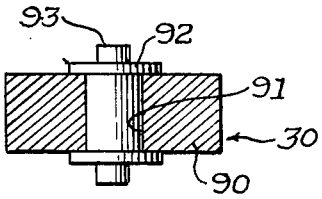
Figure 20:
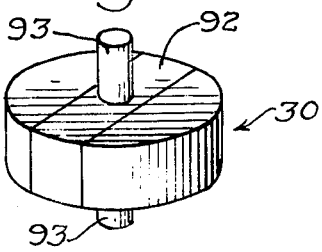

Referring in more detail to the magnetic member, generally identified in FIG. 3 as 30, improved constructions are shown in FIGS. 13–22. In FIG. 13, a magnetic ring component 90 for a magnet member is shown. The ring component is formed by sintering magnetic material into a ring having a center hole 91, which has a roughened surface. As shown in FIGS. 14, and 15, a plastic material 92 is molded in the center hole with axle portions 93 extending beyond the depth of the body of the magnet member. The plastic portion is prevented from separating from the ring by the effective interlock due to firm engagement caused by the molding of the material into the roughened surface of the ring member.

Figure 16:
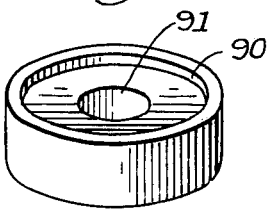
FIGS. 16 and 17 are views of another embodiment of a magnet member.
Figure 17:
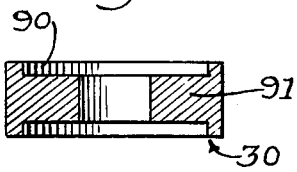

Another embodiment of the magnetic member 30 is shown in FIGS. 16 and 17 in which the magnetic material is formed into a ring like component 90 having a circumferential portion extending in a rim beyond the planes of the upper and lower surfaces thereof. This component is used as an inset in the plastic material resulting in an essentially cylindrical element which may have axles 93 extending from the surface, or which may have hollows to receive axle components from the frame of the instrument. Since the plastic material extends through the ring and over portions thereof, an interlock effect makes separation unlikely.

Figure 22:
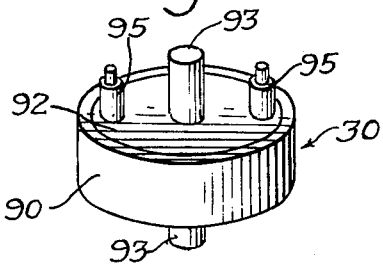

The embodiments in FIGS. 19–22 represent other variations of a magnet member in which a plastic material is molded onto the magnet material portion in an interlocking manner to provide physical connection as well as chemical bonding. In FIG. 22, the integrally molded plastic portion includes support posts 95 on which iris blades or vanes, or indicators may be mounted in a known manner, such as by being cemented or staked.

In summary, a magnet member having axles and support posts is provided requiring a minimum of components an therefore a minimum of assembly steps. The magnet member has a flux density comparable to more conventional magnet members of greater cost resulting from the requirement that several assembly steps are necessary.

Since the several components are molded, and dimensions are maintained to standards, the components are readily assembled into a moving magnet instrument.

What is claimed is:

1. Improvements in a moving magnet instrument in which a magnet member moves relative to a frame unit in response to variations in current flow through a coil fixed relative to the frame unit and relative to which the magnet member is rotatable arcuately in response to current flow variations through the coil, the improvement comprising:

the frame unit being of two piece construction capable of assembly into a unit, each piece having a bearing alignable with the other bearing upon assembly of the respective pieces;

the magnet member being formed with magnetic material and a plastic material interlocked to prevent separation of one material from the other, and having an axle portion located in said bearings formed in said frame unit thereby defining an axis about which said magnet member is rotatable in the magnetic field of the fixed coil whereby said magnet member is rotatable in response to current which flows through the coil.

2. An improvement in a moving magnet instrument as in claim 1 wherein said magnet member is movable axially of said bearings, and including magnet member biassing means arranged on said frame proximate said magnet member to bias said magnet member axially.

3. An improvement in a moving magnet instrument as in claim 2 wherein said magnet member biassing means is of magnetic material generating a magnetic field opposing a portion of the magnetic field of the magnetic member.

4. An improvement in a moving magnet instrument as in claim 2 wherein said magnet member biassing means is arranged adjacent said bearing of said magnet member.

5. An improvement in a moving magnet instrument as in claim 1 wherein said magnet member is formed of a single piece of magnetic material and a single piece of plastic material, and said materials being physically joined together with the axle being molded integrally of the plastic material.

6. An improvement in a moving magnet instrument as in claim 1 wherein said two-piece frame is retained assembled by a coil wound about the frame.

7. An improvement in a moving magnet instrument as in claim 1 wherein at least one vane support post is molded with said magnet member to move a vane carried thereon as said magnet moves.

* * * * *